US008525410B2

(12) United States Patent
Ikeuchi et al.

(10) Patent No.: US 8,525,410 B2
(45) Date of Patent: Sep. 3, 2013

(54) SHORT ARC TYPE DISCHARGE LAMP

(75) Inventors: Mitsuru Ikeuchi, Himeji (JP); Akihiro Shimizu, Himeji (JP); Tomoyoshi Arimoto, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/173,074

(22) Filed: Jun. 30, 2011

(65) Prior Publication Data

US 2012/0001541 A1 Jan. 5, 2012

(30) Foreign Application Priority Data

Jul. 2, 2010 (JP) ..... 2010-151812

(51) Int. Cl.
*H01J 61/06* (2006.01)

(52) U.S. Cl.
USPC ..... 313/632

(58) Field of Classification Search
USPC ..... 313/623–633
See application file for complete search history.

(56) References Cited

U.S. PATENT DOCUMENTS

2003/0057835 A1* 3/2003 Okanuma et al. ..... 313/631

FOREIGN PATENT DOCUMENTS

JP 2010-033825 A 2/2010

* cited by examiner

*Primary Examiner* — Anh Mai
*Assistant Examiner* — Brenitra M Lee
(74) *Attorney, Agent, or Firm* — Roberts Mlotkowski Safran & Cole, P.C.; David S. Safran

(57) ABSTRACT

A short arc type discharge lamp wherein a cathode and an anode are arranged opposite to each other in an interior of a light emitting tube and said cathode comprises a main part made from tungsten and a tip end part made from thoriated tungsten, wherein thorium oxide particles having been peripherally coated with thorium are contained in the tip end part of said cathode.

4 Claims, 4 Drawing Sheets

SHORT ARC TYPE DISCHARGE LAMP

BACKGROUND OF THE INVENTION

1. Field of the Invention

The present invention relates to short arc type discharge lamps and relates specifically to short arc type discharge lamps wherein a tip end part comprising thorium oxide is provided at the cathode.

2. Description of Related Art

As short arc type discharge lamps containing mercury have a short distance between the tip ends of a pair of electrodes arranged oppositely to each other in a light emitting tube and are close to point light sources, they are conventionally used for the light source of exposure devices with a high focusing efficiency by means of a combination with an optical system. Further, short arc type discharge lamps containing xenon are used as light sources for visible light in projectors etc., and recently, they are also used as light sources for the digital cinema. Among these short arc type discharge lamps, lamps are known which are designed to increase the electron emission characteristics by providing an emitter material at the cathode.

In JP-A-2010-33825, the configuration of a known short arc type discharge lamp and the configuration of the cathode thereof are disclosed. FIG. 7 illustrates this conventional technique wherein FIG. 7(A) is a general view of the lamp and FIG. 7(B) shows the configuration of the cathode thereof As shown in FIG. 7(A), a cathode 22 and an anode 23 made from tungsten are arranged opposite to each other in the interior of a light emitting tube 21 of a short arc type discharge lamp 20. A light emitting substance such as mercury or xenon is enclosed in said light emitting tube 21. In this drawing, a condition is shown where the short arc type discharge lamp 20 is lighted vertically, but depending on the use there are also lamps which are lighted horizontally.

The configuration of the cathode in this lamp is shown in FIG. 7(B). The cathode 22 consists of an electrode tip end part 22*a* comprising an emitter and an electrode main part 22*b* formed integrally therewith. This electrode tip end part 22*a* consists of tungsten containing an emitter material such as thorium while the electrode main part 22*b* is formed from tungsten of high purity. This procedure of making up a lamp with good electron emission characteristics by including an emitter in the cathode tip end of the discharge lamp is previously known.

As to the shape of the emitter material of the cathode tip end containing an emitter substance, apart from a taper portion of the cathode tip end being made up completely from the emitter material such as in the above mentioned known technique, also a configuration such as shown in FIG. 8 is well known. Here, the emitter material is exposed at a part of the tip end taper portion. In FIG. 8(A), a tip end part 22*a* containing the emitter substance is bonded to the taper portion 22*c* of the cathode main part 22*b*. Further, in FIG. 8(B), the tip end part 22*a* has the shape of a rod penetrating the cathode main part 22*b*, and this tip end part is configured such that it is exposed at a taper portion 22*c* of said cathode main part 22*b*.

But in the above mentioned example of the prior art, the emitter substance contributing to the improvement of the electron emission characteristics is actually limited to the emitter substance being contained within a very shallow region from the surface of the cathode tip end. This is because the quantity of the emitter substance being supplied to the cathode tip end surface from the inner portion of the cathode having a lower temperature by means of heat diffusion is low in comparison to the quantity of the emitter substance being evaporated and consumed by means of the heat of the surface of the cathode tip end where the temperature becomes highest. Thus, even if a large quantity of the emitter substance is contained in the cathode inner portion, the phenomenon arises that the supply thereof from the inner portion to the surface becomes insufficient while there is a shortage of the emitter substance at the surface. Therefore, with the above mentioned known technique there is the problem that although an emitter substance is contained in the cathode tip end, this emitter substance is not utilized sufficiently, and when the emitter material at the cathode tip end surface is depleted, the electron emission characteristics decrease and flicker occurs.

In view of the above-mentioned problems of the known technique, this invention has the object to provide a short arc type discharge lamp having a cathode being configured such that an emitter substance is provided in the tip end, wherein a shortage of the emitter substance at the cathode surface is avoided by means of aiming at an effective utilization by letting the emitter substance being contained in the inner portion of the cathode tip end migrate to the surface, and an extension of the flicker durability of the lamp is intended.

SUMMARY OF THE INVENTION

To solve the above-mentioned problems, in this invention a short arc type discharge lamp wherein a cathode and an anode are arranged opposite to each other in the interior of a light emitting tube and said cathode comprises a main part made from tungsten and a tip end part made from thoriated tungsten is characterized in that thorium oxide particles having been peripherally coated with thorium are contained in the tip end part of said cathode.

As, according to the present invention, thorium oxide particles having been peripherally coated with thorium are contained in the cathode tip end part containing thorium oxide, this thorium-coated thorium oxide is made to migrate because of heat to the surface having a higher temperature and is supplied sufficiently to this surface. Thus, the condition of a depletion of the thorium oxide at the surface does not occur and a lamp with a long flicker durability can be implemented

DETAILED DESCRIPTION OF THE INVENTION

Figure 1:
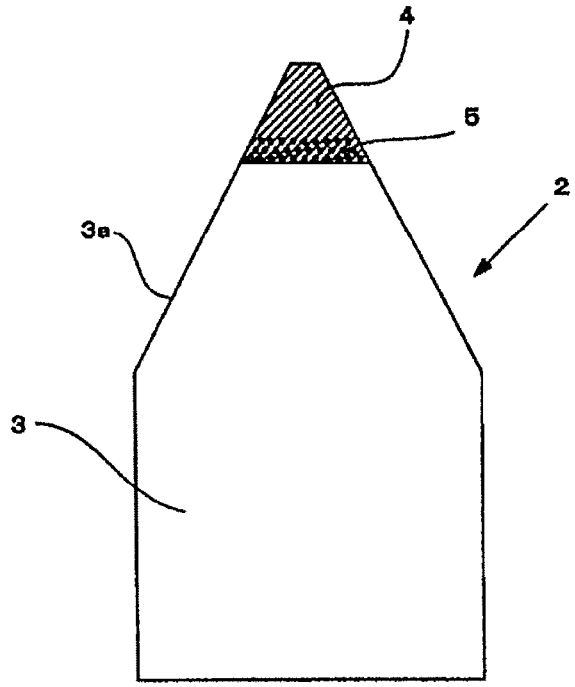
FIG. 1 is a schematic sectional view of an electrode of the discharge lamp according to the present invention.

FIG. 1 shows the configuration of a first embodiment of a cathode of the short arc type discharge lamp of this invention.

The cathode 2 comprises a main part 3 made from tungsten and a tip end part 4 which has been diffusion bonded to the tip end thereof. Here, diffusion bonding means a solid-phase bonding wherein metals are arranged on top of each other and are heated and pressed in the solid state below the melting point so that no plastic deformation occurs, and the atoms of the bonded part are diffused.

Said tip end part 4 for which thorium oxide ($ThO_2$) as the emitter substance has been incorporated into tungsten being the main component is so-called thoriated tungsten. The thorium oxide content amounts to, for example, 2 wt. %. Said tip end part 4 has, as a whole, an approximately frustoconical shape and is bonded to the taper portion 3*a* of said main part 3. The tip end face thereof is arranged opposite to an anode which is not shown.

Normally, the thorium oxide being contained in the thoriated tungsten which makes up the tip end part 4 is reduced to thorium atoms by means of reaching a high temperature during the lighting of the lamp and is diffused at the outer surface and migrates to the tip end side where the temperature is high. By means of this, the work function can be decreased and the electron emission characteristics can be improved.

In the present invention, thorium oxide particles 5 having been coated with thorium (in the following referred to as 'thorium-coated thorium oxide particles') are contained in the tip end part 4 of said cathode 2. These thorium-coated thorium oxide particles 5 are mainly contained in the vicinity of the region in which the tip end part 4 is bonded to the main part 3.

Figure 7A:
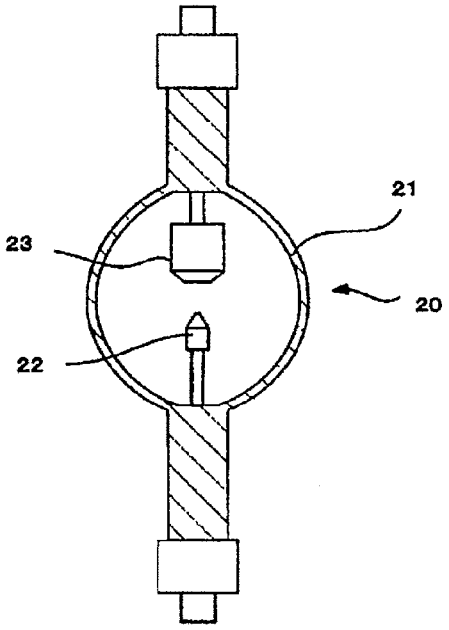
Fig. 7(A) (Prior Art)
FIGS. 7(A) and 7(B) are sectional views of a known short arc type discharge lamp.
Figure 7B:
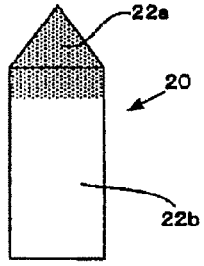
Fig. 7(B) (Prior Art)

Now, in FIG. 1, a configuration is shown wherein the tip end part 4 is bonded to the taper portion 3*a* of the main body 3, but it is also possible to bond it to the columnar-shaped portion of the main body 3 such as shown in FIG. 7(B).

Figure 2:
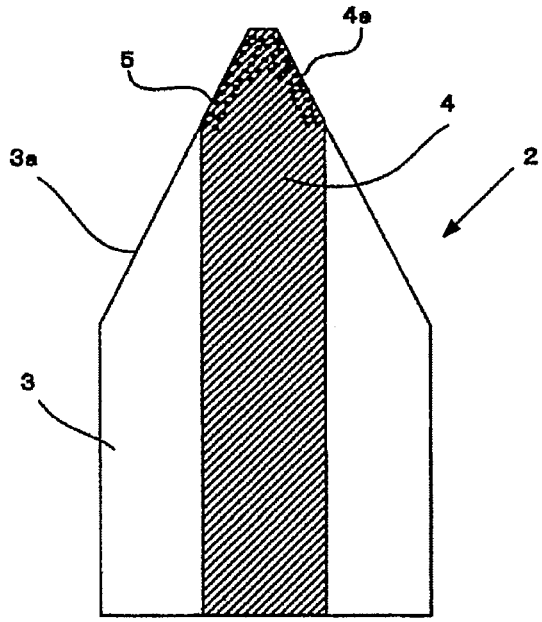
FIG. 2 is a schematic sectional view of another embodiment.

FIG. 2 shows a different embodiment wherein the tip end part 4 is elongated such that it penetrates the main part 4 and the taper-shaped tip end face 4*a* is exposed to the outside in the vicinity of the taper portion 3*a* of the main part 3. Similar to FIG. 1, also this tip end part 4 contains thorium-coated thorium oxide particles 5, and in this embodiment these particles are contained in a specified depth direction from the vicinity of the taper-shaped tip end face 4*a* of the tip end part 4.

Next, the method for forming these thorium-coated thorium oxide particles will be explained as follows. In thoriated tungsten, thorium oxide particles are present as an inclusion in the tungsten, and when carbon is introduced into this tungsten, the carbon atoms dissolve solidly as interstitial impurities. If a high temperature is reached, there is a reaction with the solidly dissolved carbon atoms at the surface of the thorium oxide particles and a reduction occurs and metallic thorium is formed. At the same time, carbon monoxide is generated.

$$ThO_2+2C \leftrightarrows Th+2CO$$

As the thorium oxide particles are surrounded by tungsten, the generated carbon monoxide accumulates in these gaps. When the pressure of the generated carbon monoxide increases, the above-mentioned reaction stops. The carbon monoxide having been accumulated in the tungsten dissolves in the peripheral tungsten and balances out.

$$CO \leftrightarrows [C]w+[O]w$$

Here, [C]w is the carbon solidly dissolved in the tungsten, and [O]w is the oxygen solidly dissolved in the tungsten. Further, when [C]w and [O]w diffuse and escape to the outside, the carbon monoxide pressure decreases and the reduction of thorium oxide continues. That is, the reduction of thorium oxide is rate-determined by the diffusion of [C]w and [O]w. That is, if there is a lot of carbon present in the vicinity and the diffusion of [C]w and [O]w is performed efficiently, metallic thorium is generated and thorium oxide particles having a shell-shaped thorium coating are formed.

As to the method of introducing carbon into the tungsten, adhering solid carbon to the surface of the thoriated tungsten and performing a heat treatment or solidly dissolving carbon into the tungsten by performing a heat treatment of the thoriated tungsten in an atmosphere containing carbon are possible.

Next, a method to produce the cathode with the configuration of FIG. 1 will be explained. FIG. 3 shows this production method.

Figures 3A, 3B, 3C, 3D, 3E:
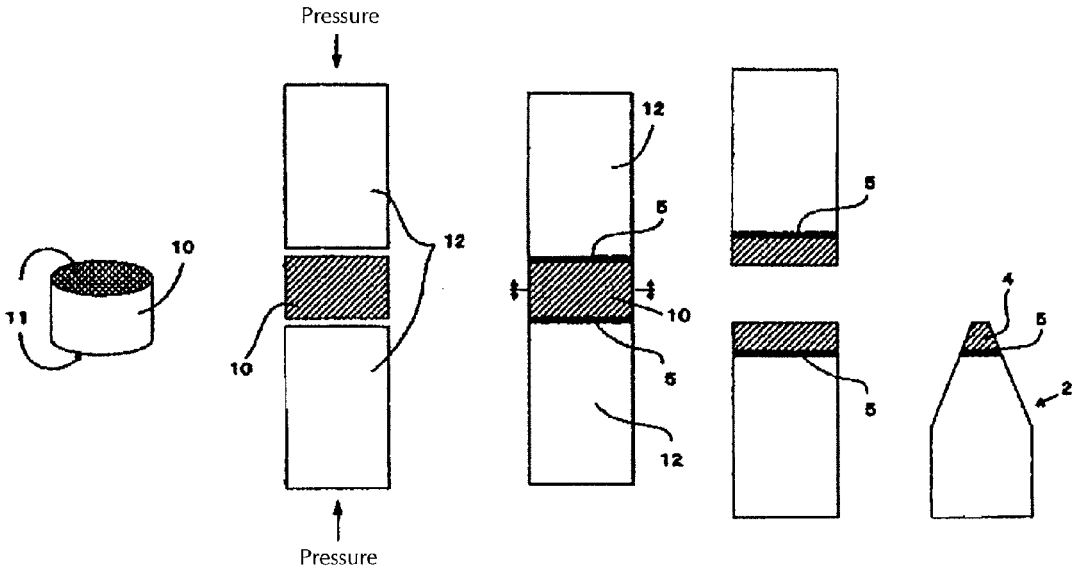
FIGS. 3(A) to 3(E) are schematic explanatory views of the method to produce the cathode with the configuration of FIG. 1.

FIG. 3(A): A disc 10 of thoriated tungsten with a diameter of 10 mm and a thickness of 5 mm is cut. After carbon has been applied to both end faces thereof, a heat treatment for 30 minutes at approximately 1500° C. is performed in a vacuum. By means of this, a thin carbide layer 11 is formed on both end faces of the thoriated tungsten disc 10.

FIG. 3 (B): This thoriated tungsten disc 10 with the adherent carbide layers 11 is inserted between pure tungsten rods 12, 12 with a diameter of 10 mm and a length of 20 mm and then a compression pressure of approximately 200 N is applied in the axial direction in a vacuum. Further, heating by means of applying a current is performed so that the temperature of the joining portion reaches approximately 2200° C. When the heating is performed for about 10 minutes, the pure tungsten rods 12 and the thoriated tungsten disc 10 are diffusion-bonded.

FIG. 3 (C): As a large quantity of carbon is present at the joining region and CO gas escapes easily until the bonding is finished, the thorium oxide particles become 'thorium-coated thorium oxide particles'.

FIG. 3 (D): The bonded rod is cut in the center of the thoriated tungsten disc 10.

FIG. 3 (E): The tip ends are machined and cathodes 2 having a tip end part 4 with a thickness of approximately 2 mm consisting of thoriated tungsten which contains thorium-coated thorium oxide particles 5 are obtained.

Another method to produce the cathode with the configuration of FIG. 1 will be explained on basis of FIG. 4.

Figures 4A, 4B, 4C, 4D:
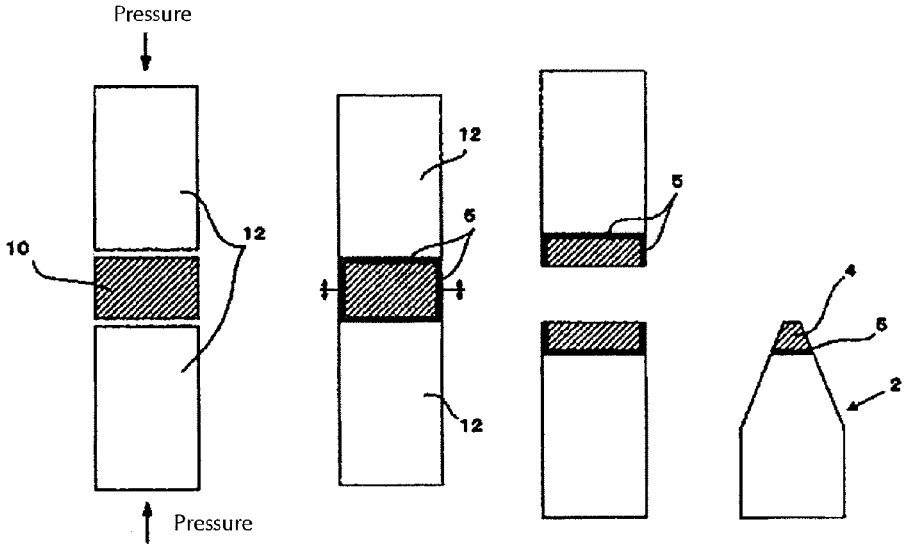
FIGS. 4(A) to 4(D) are schematic explanatory views of another production method.

FIG. 4(A): A thoriated tungsten disc 10 with a diameter of 10 mm and a thickness of 5 mm is inserted between pure tungsten rods 12, 12 with a diameter of 10 mm and a length of 20 mm, and a compression pressure of approximately 200 N is applied in the axial direction. Heating by applying a current is performed for approximately 10 minutes while a gas, for which benzene was added to hydrogen is flowed as the atmosphere gas, and the temperature of the abutting portions is brought to approximately 1600° C. During this, atmosphere gas enters because of the presence of gaps at the abutting portions and a state is achieved in which the carbon in the benzene is present between the abutting portions.

FIG. 4(B): The atmosphere gas is substituted by hydrogen and heating with approximately 2100° C. for about 15 minutes is performed by means of which the pure tungsten rods 12 and the thoriated tungsten disc 10 are diffusion-bonded. During this, the carbon from the benzene is supplied sufficiently between the abutting portions while, on the other hand, carbon monoxide escapes quickly from the gaps of the joining portions. Therefore, thorium-coated thorium oxide particles 54 are formed in the thoriated tungsten.

FIG. 4(C): The bonded rod is cut in the center of the thoriated tungsten disc 10.

FIG. 4(D): The tip ends are machined and cathodes 2 having a tip end part 4 with a thickness of approximately 2 mm consisting of thoriated tungsten which contains thorium-coated thorium oxide particles 5 are obtained.

Next, a method to produce the cathode with the configuration of FIG. 2 will be explained on the basis of FIG. 5.

Figure 5A:
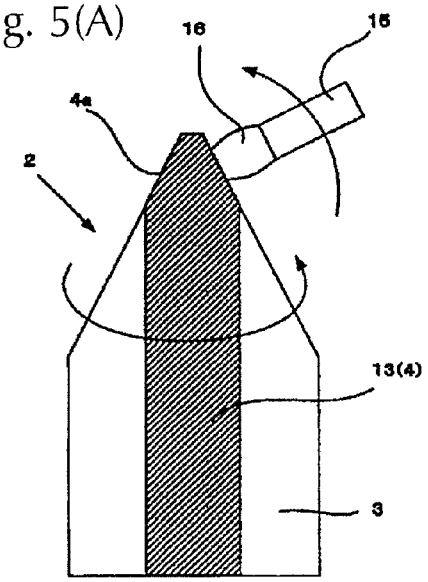
FIGS. 5(A) and 5(B) are schematic explanatory views of the method to produce the cathode with the configuration of FIG. 2.

FIG. 5(A): A cathode 2 with a tip end diameter of 0.6 mm and a tip end angle of 60 degrees is machined from a tungsten rod with a diameter of 10 mm having a thoriated tungsten core rod 13 (tip end part 4) with a diameter of 3 mm. Thus, a cathode 2 where the tip end part 4 penetrates the electrode main part 3 is formed. An auxiliary electrode 15 is arranged close to the taper portion 4*a* of the tip end part 4 of this cathode 2 and an arc discharge 16 is generated with the auxiliary electrode being the minus side and the cathode 2 being the plus side while pure argon gas is flowed in the vicinity. While rotating the cathode 2, the current of the arc is regulated such that a temperature of approximately 2400° C. is reached in the high-temperature portion of the region contacted by the arc 16. The atmosphere gas is substituted with a gas for which a small quantity (~0.1%) of methane was added to argon and the arc heating is continued for about 10 minutes. At this time, carbon from the methane is supplied sufficiently in the vicinity of the taper portion 4*a* of the tip end part 4 of the cathode 2 while carbon monoxide escapes from the surface. Therefore, the thorium oxide particles become thorium-coated thorium oxide particles 5 in the region close to the taper portion 4*a* of the tip end part 4 (thoriated tungsten core rod 13).

Figure 5B:
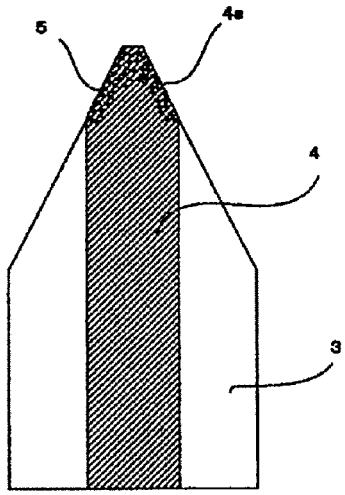

FIG. 5(B): Afterwards, the atmosphere gas is substituted by pure argon, the arc is extinguished and a cooling is performed by means of which a cathode 2 where thorium-coated thorium oxide particles 5 are contained in the tip end of the tip end part 4 is obtained.

In doing so, a cathode wherein thorium-coated thorium oxide particles are contained in the thoriated tungsten is obtained. In the following, the mechanism of the migration of said thorium-coated thorium oxide particles in the tungsten will be explained.

Figure 6:
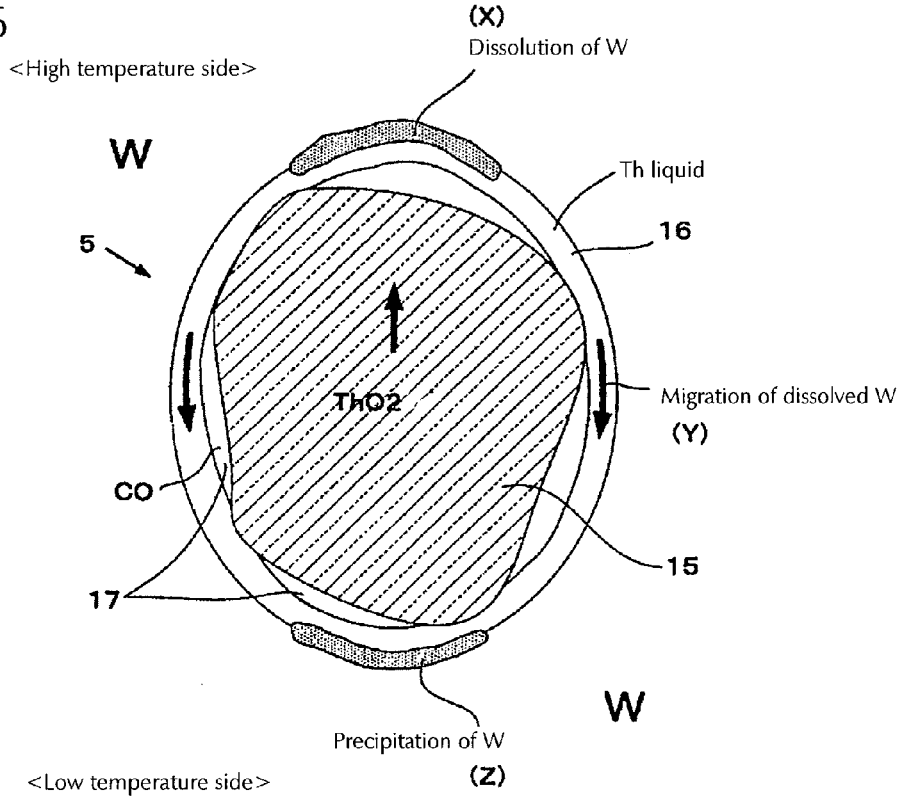
FIG. 6 is a schematic explanatory view of the effects of the present invention.

FIG. 6 shows a schematic view of a thorium-coated thorium oxide particle 5. At the periphery of a thorium oxide ($ThO_2$) particle 15, a shell-shaped thorium (Th) coating 16 is formed, and between these two, gaps 17 are formed in part. In these gaps 17, carbon monoxide (CO) having been generated during the above-mentioned reduction reaction is enclosed. In the vicinity of this thorium-coated thorium oxide particle 5 tungsten W is present. During the lighting of the lamp the temperature of the cathode increases, and when the melting point of thorium (approximately 1750° C.) is exceeded the metallic thorium 16 melts and liquefies. Because of the surface tension this molten thorium metal 16 reaches a state in which it forms a coating while wetting the inner surface of the tungsten W surrounding the thorium oxide particle 15. The thorium melt liquid dissolves the tungsten in the vicinity until it finally reaches a saturated state (X).

The ability of the thorium melt liquid to dissolve tungsten depends on the temperature of said thorium melt liquid, and the solubility increases with the temperature. Therefore, the thorium melt liquid dissolves more tungsten W at the high temperature side. Thus the concentration of the tungsten dissolved in the thorium melt liquid becomes high at the high temperature side and low at the low temperature side, because of which a concentration gradient arises between these sides and the dissolved tungsten is exported because of this concentration gradient from the high temperature side with the high concentration to the low temperature side with the low concentration (Y). But as the solubility is low at the low temperature side, the concentration of the tungsten in the thorium melt liquid exceeds the solubility at the low temperature side and the dissolved tungsten precipitates at the wall surface of the surrounding tungsten (Z).

To summarize the above-mentioned processes, the tungsten wall at the high temperature side dissolves (X), migrates to the low temperature side (Y) and precipitates at the wall of the low temperature side (Z) via the thorium melt liquid 16, because of which a state occurs in which the thorium oxide particle 15 as a whole has migrated to the high temperature side. That is, in the region with a temperature of at least 1750° C. being the melting temperature of thorium a migration of the thorium-coated thorium oxide particles towards the high temperature side occurs. As, normally, the tip end surface of the cathode has a higher temperature, the thorium-coated thorium oxide particles migrate towards the cathode tip end surface and thorium oxide can be transported to the tip end surface. As the solubility of tungsten becomes higher with the increasing cathode temperature, the migration speed of the thorium-coated thorium oxide particles increases.

The following experiment was performed to confirm the results of the present invention. As to the configuration of the commonly used lamp, a 4 kW xenon lamp for the digital cinema being the lamp with the highest cathode load was used. The lamp voltage was 30 V and the lamp current was 135 A.

Conventional Lamp (1)

Figure 8A:
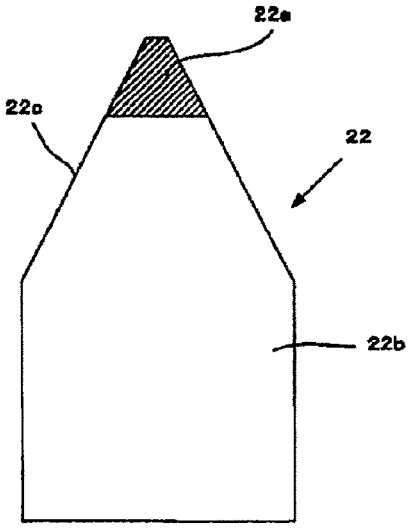
Fig. 8(A) (Prior Art)
FIGS. 8(A) and 8(B) are sectional views of a cathode with another conventional configuration.

This lamp was provided with the cathode shown in FIG. 8(A). The cathode with a length of the thoriated tungsten part of 2 mm, a diameter of 10 mm, a length of 18 mm, a tip end diameter of 0.6 mm and a tip end angle of 60 degrees was cut from a material for which thoriated tungsten containing 2 wt. % of thorium oxide and pure tungsten had been diffusion-bonded. The durability of this lamp because of flicker was 422 hours.

Conventional lamp (2)

Figure 8B:
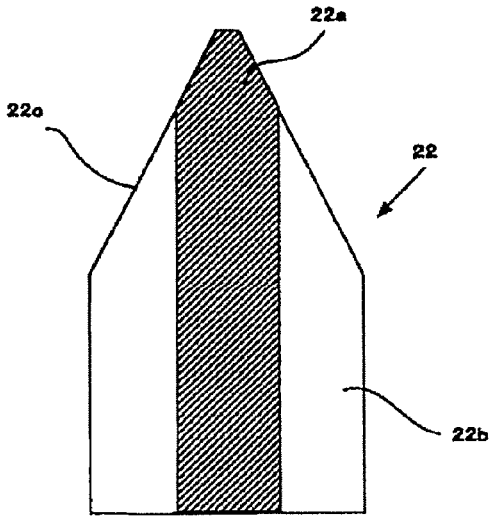
Fig. 8(B) (Prior Art)

This lamp was provided with the cathode shown in FIG. 8(B). The cathode with a diameter of 10 mm, a length of 18 mm, a tip end diameter of 0.6 mm and a tip end angle of 60 degrees was cut from a tungsten rod with a diameter of 10 mm having a thoriated tungsten core rod with a diameter of 3 mm. The durability of this lamp because of flicker was 460 hours.

Lamp of the Present Invention (1)

This lamp was provided with the cathode shown in FIG. 1. An object, for which thoriated tungsten in which thorium-coated thorium oxide particles had been formed and pure tungsten were bonded and the thickness of the thoriated tungsten part was set to 2 mm was used and a cathode with a diameter of 10 mm, a length of 18 mm, a tip end diameter of 0.6 mm and a tip end angle of 60 degrees was cut therefrom. The durability of this lamp because of flicker was 617 hours.

Lamp of the Present Invention (2)

This lamp was provided with the cathode shown in FIG. 2. It was a cathode having a diameter of 10 mm, a length of 18 mm a tip end diameter of 0.6 mm, a tip end angle of 60 degrees and a thoriated tungsten core rod (tip end part) in which thorium-coated thorium oxide particles had been formed with a diameter of 3 mm. The durability of this lamp because of flicker was 586 hours.

The above-mentioned results are summarized in table 1.

TABLE 1

| | cathode shape | flicker durability |
|---|---|---|
| conventional lamp (1) | cathode of FIG. 8(A) | 422 hr |
| lamp of the present invention (1) | cathode of FIG. 1 | 617 hr |
| conventional lamp (2) | cathode of FIG. 8(B) | 460 hr |
| lamp of the present invention (2) | cathode of FIG. 2 | 586 hr |

As will be understood from table 1, a significant improvement in the flicker durability was recognized even for electrodes with the same shape, when thoriated tungsten was used as the emitter material and thorium-coated thorium oxide particles were formed and included therein.

Because, as was mentioned above, according to the present invention thorium oxide particles peripherally coated with thorium are contained in the thoriated tungsten being the emitter material, said thorium-coated thorium oxide particles migrate to the high temperature tip end surface side because of the temperature gradient of the cathode and the consumption of the thorium oxide at said cathode tip end surface is compensated. By means of this, thorium oxide in the interior of the cathode which had not been utilized before is effectively utilized and the flicker durability can be extended.

The invention claimed is:

1. A short arc type discharge lamp wherein a cathode and an anode are arranged opposite to each other in an interior of a light emitting tube and said cathode comprises a main part made from pure tungsten and a tip end part made from thoriated tungsten, wherein thorium oxide particles having been peripherally coated with thorium are contained in the tip end part of said cathode.

2. The short arc type discharge lamp according to claim 1, wherein the tip end part of said cathode is diffusion-bonded to the tip end of the main part.

3. The short arc type discharge lamp according to claim 1, wherein the tip end part of said cathode is provided such that it penetrates the main part.

4. The short arc type discharge lamp according to claim 1, wherein the thorium coating of the thorium-coated thorium oxide particles is obtained by reducing the thorium oxide at the surface of the thorium oxide particles.

* * * * *